US007794585B2

(12) United States Patent
Leonard et al.

(10) Patent No.: US 7,794,585 B2
(45) Date of Patent: Sep. 14, 2010

(54) HYDROCARBON CONVERSION PROCESS

(75) Inventors: Laura Elise Leonard, Des Plaines, IL (US); Peter Kokayeff, Des Plaines, IL (US); Michael Roy Smith, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 194 days.

(21) Appl. No.: 11/872,084

(22) Filed: Oct. 15, 2007

(65) Prior Publication Data

US 2009/0095651 A1 Apr. 16, 2009

(51) Int. Cl.
*C10G 65/02* (2006.01)

(52) U.S. Cl. ..... 208/89; 208/49; 208/57; 208/59; 208/212

(58) Field of Classification Search ..... 208/49, 208/57, 59, 89, 212
See application file for complete search history.

(56) References Cited

U.S. PATENT DOCUMENTS

| | | | | |
|---|---|---|---|---|
| 3,130,006 | A | 4/1964 | Rabo et al. | 23/110 |
| 3,668,112 | A | 6/1972 | Parker et al. | 208/89 |
| 4,363,718 | A | 12/1982 | Klotz | 208/110 |
| 4,676,887 | A | 6/1987 | Fischer et al. | 208/61 |
| 4,738,766 | A | 4/1988 | Fischer et al. | 208/68 |
| 4,789,457 | A | 12/1988 | Fischer et al. | 208/68 |
| 4,828,677 | A | 5/1989 | Fischer et al. | 208/89 |
| 4,919,789 | A | 4/1990 | Fischer et al. | 208/61 |
| 4,943,366 | A | 7/1990 | Fischer et al. | 208/68 |
| 5,403,470 | A | 4/1995 | Kokayeff et al. | 208/212 |
| 5,527,448 | A | 6/1996 | Morel et al. | 208/211 |
| 5,718,820 | A | 2/1998 | Morel et al. | 208/15 |
| 6,123,835 | A | 9/2000 | Ackerson et al. | 208/213 |
| 6,200,462 | B1 | 3/2001 | Cash et al. | 208/89 |
| 6,294,080 | B1 | 9/2001 | Thakkar et al. | 208/100 |

(Continued)

FOREIGN PATENT DOCUMENTS

EP 0 993 498 B1 8/2004

(Continued)

OTHER PUBLICATIONS

Schmitz, C. et al, "Deep desulfurization of diesel oil: Kinetic studies and process-improvement by the use of a two-phase reactor with pre-saturator," Chemical Engineering Science, vol. 59, No. 14, 2004, pp. 2821-2829.

(Continued)

*Primary Examiner*—Walter D Griffin
*Assistant Examiner*—Renee Robinson
(74) *Attorney, Agent, or Firm*—James C Paschall

(57) ABSTRACT

Methods of hydroprocessing hydrocarbon streams are provided that employ substantially liquid-phase hydroprocessing conditions. In one aspect, the method includes directing a hydrocarbonaceous feed stock to a first substantially liquid-phase hydroprocessing zone wherein an effluent from the first substantially liquid-phase hydroprocessing zone is directed to a second substantially liquid-phase hydroprocessing zone generally undiluted with other hydrocarbon streams. In another aspect, the method recycles a liquid portion of a liquid hydrocarbonaceous effluent from the second substantially liquid-phase hydroprocessing zone, which preferably includes an amount of hydrogen dissolved therein, to the hydrocarbonaceous feed stock so that the feed to the first substantially liquid-phase hydroprocessing zone has a relatively larger concentration of dissolved hydrogen relative to the hydrocarbonaceous feed stock.

20 Claims, 1 Drawing Sheet

U.S. PATENT DOCUMENTS

| | | | | |
|---|---|---|---|---|
| 6,387,245 | B1 * | 5/2002 | Kalnes et al. | 208/58 |
| 6,402,935 | B1 * | 6/2002 | Kalnes | 208/89 |
| 6,428,686 | B1 | 8/2002 | Ackerson et al. | 208/213 |
| 6,444,116 | B1 | 9/2002 | Galiasso et al. | 208/58 |
| 6,497,813 | B2 | 12/2002 | Ackerson et al. | 208/311 |
| 6,638,419 | B1 | 10/2003 | Da Silva et al. | 208/208 R |
| 6,881,326 | B2 | 4/2005 | Ackerson et al. | 208/213 |
| 6,890,425 | B2 | 5/2005 | Ackerson et al. | 208/311 |
| 6,929,738 | B1 | 8/2005 | Riley et al. | |
| 7,041,211 | B2 * | 5/2006 | Kalnes | 208/89 |
| 7,094,332 | B1 | 8/2006 | Kalnes et al. | 208/97 |
| 7,097,815 | B2 | 8/2006 | Dassori et al. | |
| 7,156,977 | B2 | 1/2007 | Wrisberg et al. | |
| 2005/0010076 | A1 | 1/2005 | Wasserscheid et al. | 585/862 |
| 2005/0082202 | A1 | 4/2005 | Ackerson et al. | 208/213 |
| 2006/0144756 | A1 | 7/2006 | Ackerson et al. | 208/108 |

FOREIGN PATENT DOCUMENTS

WO WO 00/34416 * 6/2000

OTHER PUBLICATIONS

Datsevitch, L. et al., "Improvement of the deep desulfurization of diesel fuel by pre-saturation and a recycle of the liquid phase," DGMK Tagungsber., 2003, pp. 321-328, Chemical Abstracts 140(15/16), Abstract No. 255917 (2004).

Gudde, N.J. et al., "Improving deep sulfur removal from motor fuels by the use of a pre-saturator and a liquid circuit," Chemie-Ingenieur-Technik, vol. 75, No. 8, 2003, p. 1040, and English language abstract (1 page).

Boesmann, A. et al., "Deep desulfurization of diesel fuel by extraction with ionic liquids," Chem. Commun., vol. 23, 2001, pp. 2494-2495, Chemical Abstracts 136(9/10), Abstract No. 153666 (2002).

Stratiev, D. et al., "Investigation on the effect of heavy diesel fraction properties on product sulphur during ultra deep diesel hydrodesulphurization," Erdol Erdgas Kohle, vol. 122, No. 2, 2006, pp. 59-60, 62-63, Urban Verlag Hamburg/Wien GmbH, Germany.

Gatte, R. et al., "Hydrogen processing. Hydrotreating. General Process.", National Petrochemical and Refiners Association, 1999 NPRA Question and Answer Session on Refining and Petrochemical Technology, Washington, D.C., pp. 140-158.

Johnson, T.E., "Weigh options for meeting future gasoline sulfur specifications," Fuel Technology & Management, vol. 7, No. 2, pp. 16,18 (Mar. 1997).

U.S. Appl. No. 11/300,007, filed Dec. 14, 2005, Leonard.

U.S. Appl. No. 11/460,307, filed Jul. 27, 2006, Leonard.

U.S. Appl. No. 11/618,623, filed Dec. 29, 2006, Kokayeff.

U.S. Appl. No. 11/872,140, filed Oct. 15, 2007, Kokayeff.

U.S. Appl. No. 11/872,102, filed Oct. 15, 2007, Kokayeff.

U.S. Appl. No. 11/872,251, filed Oct. 15, 2007, Kokayeff.

U.S. Appl. No. 11/872,312, filed Oct. 15, 2007, Kokayeff.

U.S. Appl. No. 12/165,444, filed Jun. 30, 2008, Petri.

U.S. Appl. No, 12/165,499, filed Jun. 30, 2008, Kokayeff.

U.S. Appl. No. 12/165,522, filed Jun. 30, 2008, Kokayeff.

U.S. Appl. No. 12/495,574, filed Jun. 30, 2009, Petri.

U.S. Appl. No. 12/495,601, filed Jun. 30, 2009, Petri.

Office Action dated Jun. 4, 2009 in U.S. Appl. No. 11/460,307, Leonard.

Office Action dated Jun. 12, 2009 in U.S. Appl. No. 11/618,623, Kokayeff.

* cited by examiner

HYDROCARBON CONVERSION PROCESS

FIELD

The field generally relates to hydroprocessing of hydrocarbon streams and, more particularly, to catalytic hydrocracking and hydrotreating of hydrocarbon streams.

BACKGROUND

Petroleum refiners often produce desirable products such as turbine fuel, diesel fuel, middle distillates, naphtha, and gasoline boiling hydrocarbons among others by hydroprocessing a hydrocarbon feed stock derived from crude oil or heavy fractions thereof. Hydroprocessing can include, for example, hydrocracking, hydrotreating, hydrodesulfurization and the like. Feed stocks subjected to hydroprocessing can be vacuum gas oils, heavy gas oils, and other hydrocarbon streams recovered from crude oil by distillation. For example, a typical heavy gas oil comprises a substantial portion of hydrocarbon components boiling above about 371° C. (700° F.) and usually at least about 50 percent by weight boiling above 371° C. (700° F.), and a typical vacuum gas oil normally has a boiling point range between about 315° C. (600° F.) and about 565° C. (1050° F.).

Hydroprocessing is a process that uses a hydrogen-containing gas with suitable catalyst(s) for a particular application. In many instances, hydroprocessing is generally accomplished by contacting the selected feed stock in a reaction vessel or zone with the suitable catalyst under conditions of elevated temperature and pressure in the presence of hydrogen as a separate phase in a three-phase system (gas/liquid/solid catalyst). Such hydroprocessing is commonly undertaken in a trickle-bed reactor where the continuous phase is gaseous and not liquid.

In the trickle bed reactor, an excess of the hydrogen gas is present in the continuous gaseous phase. In many instances, a typical trickle-bed hydroprocessing reactor requires up to about 10,000 SCF/B of hydrogen at pressures up to 17.3 MPa (2500 psig) to effect the desired reactions. However, even though the trickle bed reactor has a continuous gaseous phase due to the excess hydrogen gas, it is believed that the primary reactions are taking place in the liquid-phase in contact with the catalyst, such as in the liquid filled catalyst pores. As a result, for the hydrogen gas to get to the active sites on the catalyst, the hydrogen must first diffuse from the gas phase into the liquid-phase and then through the liquid to the reaction site adjacent the catalyst.

While not intending to be limited by theory, under some hydroprocessing conditions the hydrogen supply available at the catalytic reaction site may be a rate limiting factor in the hydroprocessing conversions. For example, hydrocarbon feed stocks can include mixtures of components having greatly differing reactivities. While it may be desired, for example, to reduced the nitrogen content of a vacuum gas oil to very low levels prior to introducing it as a feed to a hydrocracking reactor, the sulfur containing compounds of the vacuum gas oil will also undergo conversion to hydrogen sulfide. Many of the sulfur containing compounds tend to react very rapidly at the operating conditions required to reduce the nitrogen content to the desired levels for hydrocracking. The rapid reaction rate of the sulfur compounds to hydrogen sulfide will tend to consume hydrogen that is available within the catalyst pore structure thus limiting the amount of hydrogen available for other desired reactions, such as denitrogenation. This phenomenon is most acute within the initial portions (i.e., about 50 to about 75 percent) of the reaction zones. Under such circumstances with the rapid reaction rate of sulfur compounds, for example, it is believed that the amount of hydrogen available at the active catalyst sites can be limited by the diffusion of the hydrogen through the feed (especially at the initial portions of the reactor). In these circumstances, if the diffusion of hydrogen through the liquid to the catalyst surface is slower than the kinetic rates of reaction, the overall reaction rate of the desired reactions (i.e., denitrogenation, for example) may be limited by the hydrogen supply and diffusion. In one effort to overcome the limitations posed by this phenomenon (hydrogen depletion), hydroprocessing catalysts can be manufactured in small shapes such as tri-lobes and quadric-lobes where the dimension of the lobe may be on the order of 1/30 inch. However, such small catalyst dimensions also can have the shortcoming of creating larger pressure drops in the reactor due to the more tightly packed catalyst beds.

Two-phase hydroprocessing (i.e., a liquid hydrocarbon stream and solid catalyst) has been proposed to convert certain hydrocarbon streams into more valuable hydrocarbon streams in some cases. For example, the reduction of sulfur in certain hydrocarbon streams may employ a two-phase reactor with pre-saturation of hydrogen rather than using a traditional three-phase system. See, e.g., Schmitz, C. et al., "Deep Desulfurization of Diesel Oil: Kinetic Studies and Process-Improvement by the Use of a Two-Phase Reactor with Pre-Saturator," Chem. Eng. Sci., 59:2821-2829 (2004). These two-phase systems only use enough hydrogen to saturate the liquid-phase in the reactor. As a result, the reactor systems of Schmitz et al. have the shortcoming that as the reaction proceeds and hydrogen is consumed, the reaction rate decreases due to the depletion of the dissolved hydrogen. As a result, such two-phase systems as disclosed in Schmitz et al. are limited in practical application and in maximum conversion rates.

Other uses of liquid-phase reactors to process certain hydrocarbonaceous streams require the use of diluent/solvent streams to aid in the solubility of hydrogen in the unconverted oil feed and require limits on the amount of gaseous hydrogen in the liquid-phase reactors. For example, liquid-phase hydrotreating of a diesel fuel has been proposed, but requires a recycle of hydrotreated diesel as a diluent blended into the oil feed prior to the liquid-phase reactor. In another example, liquid-phase hydrocracking of vacuum gas oil is proposed, but likewise requires the recycle of hydrocracked product into the feed to the liquid-phase hydrocracker as a diluent. In each system, dilution of the feed to the liquid-phase reactors is required in order to effect the desired reactions. Because hydrotreating and hydrocracking typically require large amounts of hydrogen to effect their conversions, a large hydrogen demand is still required even if these reactions are completed in liquid-phase systems. As a result, to maintain such a liquid-phase hydrotreating or hydrocracking reaction and still provide the needed levels of hydrogen, the diluent or solvent of these prior liquid-phase systems is required in order to provide a larger relative concentration of dissolved hydrogen as compared to unconverted oil to insure adequate conversions can occur in the liquid-phase hydrotreating and hydrocracking zones. As such, larger and more complex liquid-phase systems are needed to achieve the desired conversions that still require large supplies of hydrogen.

These prior art systems also may permit the presence of some hydrogen gas in the liquid-phase reactors, but the systems are generally limited to about 10 percent or less hydrogen gas by total volume of the reactor. Depending on the feed compositions and operating conditions, such limits on hydrogen gas in the liquid-phase system tend to restrict the overall reaction rates and the per-pass conversion rates in such liquid-phase reactors.

Although a wide variety of process flow schemes, operating conditions and catalysts have been used in commercial petroleum hydrocarbon conversion processes, there is always a demand for new methods and flow schemes that provide more useful products and improved product characteristics. In many cases, even minor variations in process flows or operating conditions can have significant effects on both quality and product selection. There generally is a need to balance economic considerations, such as capital expenditures and operational utility costs, with the desired quality of the produced products.

SUMMARY

In one aspect, methods of hydroprocessing a hydrocarbonaceous stream are provided that employ substantially liquid-phase hydroprocessing conditions where a feed stream includes the combination of a hydrocarbonaceous feed stock, a previously hydroprocessed liquid-phase hydrocarbonaceous stream, and hydrogen. The hydrogen content of the feed stream is preferably provided by hydrogen from the previously hydroprocessed liquid-phase hydrocarbonaceous stream and added hydrogen. The added hydrogen is provided in an amount effective to increase the hydrogen content of the feed stream while maintaining the feed stream in substantially liquid-phase conditions.

In general, one method includes directing such feed stream to a first substantially liquid-phase hydroprocessing zone wherein at least a portion of an effluent from the first substantially liquid-phase hydroprocessing zone is directed to a second substantially liquid-phase hydroprocessing zone. By one approach, the effluent or portion thereof from the first substantially liquid-phase hydroprocessing zone can be without a substantial hydrocarbon content provided form the second substantially liquid-phase continuous hydroprocessing zone. In such aspect, the previously hydroprocessed liquid-phase hydrocarbonaceous stream is preferably a liquid portion from an effluent stream of the second substantially liquid-phase hydroprocessing zone that is recycled to the feed stream.

In such aspects, the feed stream has an increased concentration of dissolved hydrogen relative to the unconverted oil in hydrocarbonaceous feed stock due to the admixing of the previously hydroprocessed liquid-phase hydrocarbonaceous stream with the feed stock. In this aspect, the previously hydroprocessed liquid-phase hydrocarbonaceous stream also preferably has an amount of dissolved hydrogen therein permitting a reduction in the amount of hydrogen added to the hydrocarbonaceous feed stock to obtain a hydrogen content in the feed stream to enable the desired conversion rates in the first hydroprocessing zone. Such systems generally avoid the transport limitations of the prior gas-phase systems as the dissolved hydrogen is transported in the liquid-phase of the feed stream.

In another aspect, the first hydroprocessing zone is a hydrotreating zone and the second hydroprocessing zone is a hydrocracking zone. In this aspect, the feed stream is introduced into a substantially liquid-phase continuous hydrotreating zone to produce a hydrotreating zone effluent. The feed stream includes an admixture of a hydrocarbonaceous feed stock, a portion of a liquid-phase effluent from a substantially liquid-phase continuous hydrocracking zone, and an amount of hydrogen while maintain substantially liquid-phase conditions in the hydrotreating zone. In this aspect, the added hydrogen is in an amount and in a form available for substantially consistent consumption in the hydrotreating zone.

The liquid-phase effluent from the substantially liquid-phase continuous hydrocracking zone recycled to the feed stream also preferably includes an amount of dissolved hydrogen therein. As a result, by recycling the liquid-phase effluent having hydrogen dissolved therein to the feed stock of the substantially liquid-phase continuous hydrotreating zone, a relatively larger concentration of dissolved hydrogen is provided in the feed stream relative to the unreacted hydrocarbons in the hydrocarbonaceous feed stock.

In another aspect, hydrogen also is dissolved in the hydrotreating zone effluent (i.e., the feed to the hydrocracking zone) prior to processing in the substantially liquid-phase hydrocracking zone. In this aspect, the hydrogen is in an amount and in a form available for substantially consistent consumption in the substantially liquid-phase continuous hydrocracking zone. The desired hydrogen content in the feed to the hydrocracking zone generally needed for the hydrocracking conversion rates, however, is achieved without substantial dilution by one or more other hydrocarbon streams or by providing a substantial hydrogen content from the substantially liquid-phase hydrocracking zone.

In the hydrocracking zone, the reaction conditions may cause some components of the feed to the reactor to flash into a gaseous phase. As a result, in another aspect, an effluent from the hydrocracking zone is separated into a gas-phase effluent, which includes the gaseous phase formed in the substantially liquid-phase continuous hydrocracking zone, and into the liquid-phase effluent. As discussed above, the liquid-phase effluent is then recycled to the feed stream for the hydrotreating zone. In such an aspect, the separation is preferably conducted at a temperature and pressure similar to that of the hydrocracking zone to separate, for example, light hydrocarbons, hydrogen sulfide, ammonia, and C1-C4 hydrocarbons that tend to flash at the conditions of the hydrocracking zone. By separating these gaseous components prior to recycling the liquid-phase effluent, the overall pressure to maintain a liquid-phase system at the inlet to the hydrocracking reactor is reduced as only sufficient pressure is needed to generally maintain hydrogen in liquid-phase conditions rather than maintain hydrogen and other lower boiling point components in liquid-phase conditions.

In another aspect, the hydrogen added to the feed stream and/or the first hydroprocessing zone effluent is preferably added in an amount in excess of that required for saturation of these streams such that the first and second substantially liquid-phase hydroprocessing zones have a small vapor phase therein. In such aspect, the liquid-phase reactors have sufficient hydrogen therein such that the liquid-phase reactors generally have a saturated level of hydrogen throughout the reactor as the reaction proceeds. In other words, as the reactions consume dissolved hydrogen, the liquid-phase has additional hydrogen that is continuously available from a small gas phase entrained or otherwise associated with the liquid-phase to dissolve back into the liquid-phase to maintain the substantially constant level of saturation. Thus, in this aspect, the substantially liquid-phase reaction zones preferably have a generally constant level of dissolved hydrogen from one end of the reactor zone to the other. As a result, such liquid-phase reactors generally may be operated at a substantially constant reaction rate to generally provide higher conversions per pass with smaller reactor vessels.

Other embodiments encompass further details of the process, such as preferred feed stocks, preferred catalysts, and preferred operating conditions to provide but a few examples.

Such other embodiments and details are hereinafter disclosed in the following discussion of various aspects of the process.

DETAILED DESCRIPTION

Figure 1:
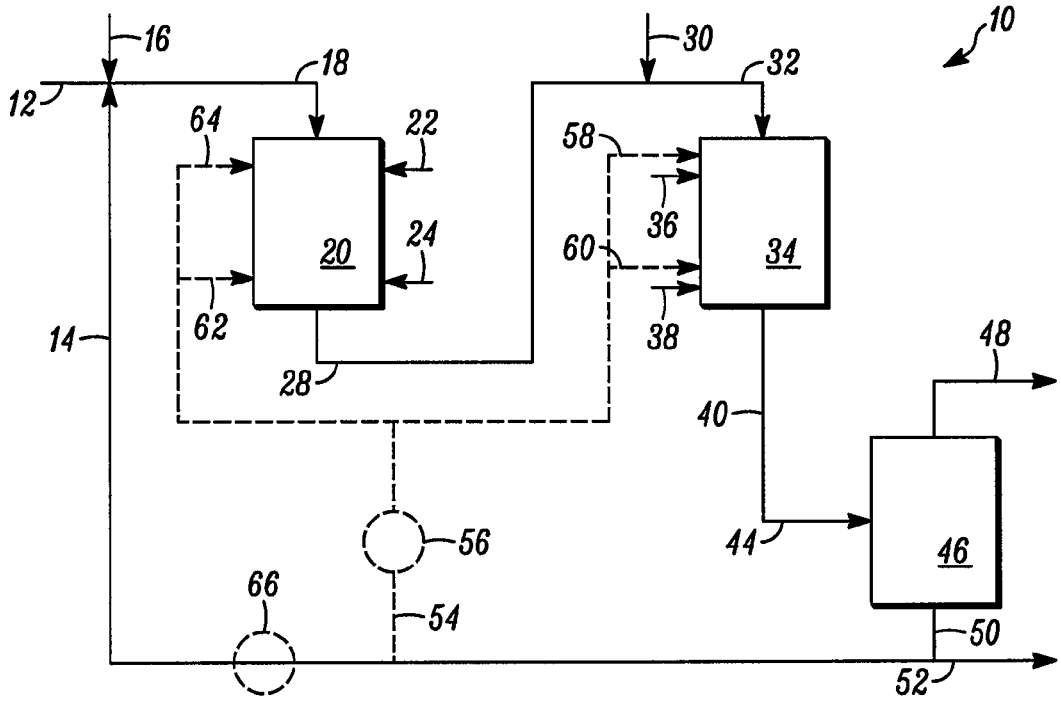
FIG. 1 is an exemplary flowchart of one example of a substantially liquid-phase hydroprocessing process.

In one aspect, the processes described herein are particularly useful for hydroprocessing a hydrocarbonaceous feed stock containing hydrocarbons and/or other organic materials to produce a product containing hydrocarbons and/or other organic materials of lower average boiling point and lower average molecular weight. Rather than using a gas-phase hydrogen delivery system that can have hydrogen transport limitations, which can be rate limiting in some circumstances, the methods herein employ liquid-phase hydroprocessing using a liquid-phase hydrogen delivery system to improve the overall ability of the systems to provide hydrogen to the active catalyst sites. Such liquid-phase systems improve the ability to source hydrogen at the active catalyst sites and, therefore, reduce any rate limiting effect that hydrogen diffusion can have on the overall conversion reactions.

In another aspect, the hydrocarbonaceous feed stocks that may be subjected to liquid-phase hydroprocessing by the methods disclosed herein include mineral oils and synthetic oils (e.g., shale oil, tar sand products, etc.) and fractions thereof. Illustrative hydrocarbon feed stocks include those containing components boiling above about 288° C. (550° F.), such as atmospheric gas oils, vacuum gas oils, deasphalted, vacuum, and atmospheric residua, hydrotreated or mildly hydrocracked residual oils, coker distillates, straight run distillates, solvent-deasphalted oils, pyrolysis-derived oils, high boiling synthetic oils, cycle oils and cat cracker distillates. In one aspect, a preferred feed stock is a gas oil or other hydrocarbon fraction having at least about 50 weight percent, and preferably at least about 75 weight percent, of its components boiling at a temperature above about 371° C. (700° F.). For example, one preferred feed stock contains hydrocarbon components which boil above about 288° C. (550° F.) with at least about 25 percent by volume of the components boiling between about 315° C. (600° F.) and about 565° C. (1050° F.). Other suitable feed stocks may have a greater or lesser proportion of components boiling in such range.

In one aspect, the processes herein are particularly suited to process hydrocarbonaceous feed stocks that include compounds of differing reactivities, such as feed stocks with high levels of nitrogen compounds, sulfur compounds, olefins, and/or aromatics to suggest but a few. By using the liquid phase hydrogen delivery systems herein, the hydroprocessing zones have sufficient hydrogen in the liquid phase effective to satisfy any rapid reaction rate conversions that can rapidly consume hydrogen (such as, for example, conversions of sulfur, olefins, and aromatics) and, at the same time, still provide sufficient hydrogen effective to also satisfy the slower reaction rate conversions (such as, for example, denitrogenation to about 20 wppm or less). In another aspect, the liquid phase reaction zones also have sufficient hydrogen throughout the reaction zone effective to generally enable the desired conversions to have a substantially constant reaction rate from the front to the end of the reaction zone even with other undesired conversions (which may have a more rapid reaction rate) consuming available hydrogen.

In one aspect, a liquid feed stream to a first substantially liquid-phase hydroprocessing zone includes the admixture of the selected hydrocarbonaceous feed stock, a hereinafter described liquid-phase hydrocarbonaceous effluent, and hydrogen. In one aspect, the liquid-phase hydrocarbonaceous effluent is from a hereinafter described second liquid-phase hydroprocessing zone. In yet another aspect, the hydrogen is preferably provided from both the liquid-phase hydrocarbonaceous effluent and added hydrogen. The added hydrogen can be admixed into the selected hydrocarbonaceous feed stock, the liquid feed stream, or anywhere upstream of the first substantially liquid-phase hydroprocessing zone.

The liquid feed stream is then introduced into the first substantially liquid-phase hydroprocessing zone, which is preferably a substantially liquid-phase hydrotreating zone operated under hydrotreating conditions to produce an effluent with hydrogen sulfide and ammonia. In one aspect, the liquid-phase hydrotreating reaction conditions for the first hydroprocessing zone include a temperature from about 204° C. (400° F.) to about 482° C. (900° F.), a pressure from about 3.5 MPa (500 psig) to about 16.5 MPa (2400 psig), a liquid hourly space velocity of the fresh hydrocarbonaceous feed stock from about 0.1 $hr^{-1}$ to about 10 $hr^{-1}$ with a hydrotreating catalyst or a combination of hydrotreating catalysts. Other suitable conditions for the specific feed stock also may be used.

In the substantially liquid-phase hydrotreating zone, the hydrogen dissolved in the liquid feed stream is used in the presence of suitable catalyst(s) that are primarily active for the removal of heteroatoms, such as sulfur and nitrogen from the hydrocarbon feed stock. In one aspect, suitable hydrotreating catalysts for use in the present invention are conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal is selected from palladium and platinum. In another aspect, more than one type of hydrotreating catalyst may be used in the same reaction vessel. In such aspect, the Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent.

In yet another aspect, the liquid feed stream to the substantially liquid-phase hydrotreating zone is saturated with hydrogen prior to being introduced to the substantially liquid-phase hydrotreating zone. Preferably, an amount of hydrogen is added to the feed stream in excess of that required to saturate the liquid such that the liquid in the substantially liquid-phase hydrotreating reaction zone also has a small vapor phase throughout. In one such aspect, an amount of hydrogen is added to the feed stream sufficient to maintain a substantially constant level of dissolved hydrogen in the liquid throughout the liquid-phase reaction zone as the reaction proceeds. Thus, as the reaction proceeds and consumes the dissolved hydrogen, there is sufficient additional hydrogen in the small gas phase to continuously provide additional hydrogen to dissolve back into the liquid-phase in order to provide a substantially constant level of dissolved hydrogen (such as generally provided by Henry's law, for example). The liquid-phase in the reaction zone, therefore, remains substantially saturated with hydrogen even as the reaction consumes dissolved hydrogen. Such a substantially constant level of dissolved hydrogen is advantageous because it provides a generally constant reaction rate in the liquid-phase reactors and can overcome the hydrogen depletion issues of the prior art systems.

In such aspect, the amount of hydrogen added to the feed stock and/or liquid feed stream to the hydrotreating zone will generally range from an amount to saturate the stream to an amount (based on operating conditions) where the stream is generally at a transition from a liquid to a gas phase, but still has a larger liquid phase than a gas phase. In one aspect, for example, the amount of hydrogen will range from about 125 to about 150 percent of saturation. In other aspects, it is expected that the amount of hydrogen may be up to about 500 percent of saturation to about 1000 percent of saturation. In some cases, the substantially liquid-phase hydrotreating zone will generally have greater than about 10 percent and, in other cases, greater than about 25 percent hydrogen gas by volume of the reactors in the hydrotreating zone. At the liquid-phase hydrotreating conditions discussed above, it is expected that about 100 to about 800 SCF/B of hydrogen will be added to the liquid feed stream to the substantially liquid-phase hydrotreating zone in order to maintain the substantially constant saturation of hydrogen throughout the liquid-phase reactor to enable the hydrotreating reactions. It will be appreciated, however, that the amount of hydrogen added to the feed can vary depending on the feed composition, operating conditions, desired output, and other factors.

With such excess hydrogen, the hydrogen will generally comprise a small bubble flow of fine or generally well dispersed gas bubbles rising through the liquid-phase in the reactor. In such form, the small bubbles aid in the hydrogen dissolving in the liquid-phase. In another aspect, the liquid-phase continuous system in the hydrotreating reaction zone may range from the vapor phase as small, discrete bubbles of gas finely dispersed in the continuous liquid-phase to a generally slug flow mode where the vapor phase separates into larger segments or slugs of gas traversing through the liquid. In either case, the liquid is the continuous phase throughout the reactors.

It should be appreciated, however, that the relative amount of hydrogen while maintaining a substantially liquid-phase continuous system, and the preferred additional hydrogen thereof, is dependent upon the specific composition of the hydrocarbonaceous feed stock, the conversion rates desired, and/or the reaction zone temperature and pressure. The appropriate amount of hydrogen required will depend on the amount necessary to provide a liquid-phase continuous system, and the preferred additional hydrogen thereof, once all of the above-mentioned variables have been selected.

During the reactions occurring in the hydrotreating reaction zone, hydrogen is necessarily consumed. In some cases, the extra hydrogen admixed into the feed beyond that required for saturation can replace the consumed hydrogen to generally sustain the reaction. In other cases, additional hydrogen also can be added to the system through one or more hydrogen inlet points located in the reaction zones. With this option, the amount of hydrogen added at these locations is controlled to ensure that the system operates as a substantially liquid-phase continuous system. For example, the additional amount of hydrogen added using the reactor inlet points is generally an amount that maintains the saturated level of hydrogen and, in some cases, an additional amount in excess of saturation as described above.

In another aspect, the liquid feed stream to the hydrotreating zone also includes the admixture of the liquid-phase hydrocarbonaceous effluent, preferably a liquid recycle from a second, downstream substantially liquid-phase hydroprocessing zone. Preferably, the liquid recycle stream is a hot-liquid recycle at the temperatures and pressures of the second hydroprocessing zone. For example, the hot-liquid recycle is at a temperature from about 232° C. (450° F.) to about 468° C. (875° F.) and a pressure from about 3.5 MPa (500 psig) to about 16.5 MPa (2400 psig); however, the conditions of the recycle will generally vary based on the feed composition, the conditions in the second hydroprocessing zone, and other factors. Additionally, for purposes of temperature control, it may be advantageous to cool a portion of the recycle stream and direct this cooler stream(s) to locations in one or both reactors to cool the reaction mixture and maintain temperature control. In another aspect, the ratio of hydrocarbonaceous feed stock to liquid recycle admixed into the liquid feed stream to the first hydroprocessing zone is about 1:1 to about 1:10 and, preferably, about 1:1 to about 1:5.

As will be discussed further below, because the liquid recycle stream has already passed through at least two separate liquid-phase reaction zones (such as a liquid-phase hydrotreating zone and a liquid-phase hydrocracking zone) this recycle stream preferably includes an amount of dissolved hydrogen therein. Preferably, the liquid recycle stream is at least saturated with hydrogen and, in some cases, has an excess amount of hydrogen to provide a small vapor phase therein. By blending this liquid recycle with an amount of hydrogen already dissolved therein into the liquid feed stream to the substantially liquid-phase hydrotreating zone, a larger amount of dissolved hydrogen is provided relative to the unreacted hydrocarbons in the feed. As a result, the liquid-phase hydrotreating reaction zone has sufficient amount of dissolved hydrogen in the liquid-phase to effect the desired hydrotreating reactions to form the effluent from the first hydroprocessing zone.

After the first hydroprocessing zone, the resulting effluent from the first liquid-phase hydroprocessing reaction zone is introduced into a second substantially liquid-phase hydroprocessing zone, such as a substantially liquid-phase hydrocracking zone to provide lower boiling hydrocarbons. In one aspect, the effluent from the hydrotreating zone (i.e., the feed to the hydrocracking zone) is combined with a hydrogen-rich gaseous stream and then introduced into the substantially liquid-phase hydrocracking zone where the added hydrogen is provided in an amount to maintain a substantially liquid-phase continuous system.

Depending on the desired output, the hydrocracking zone may contain one or more beds of the same or different catalyst. In one aspect, for example, when the preferred products are middle distillates, the preferred hydrocracking catalysts utilize amorphous bases or low-level zeolite bases combined with one or more Group VIII or Group VIB metal hydrogenating components. In another aspect, when the preferred products are in the gasoline boiling range, the hydrocracking zone contains a catalyst which comprises, in general, any crystalline zeolite cracking base upon which is deposited a minor proportion of a Group VIII metal hydrogenating component. Additional hydrogenating components may be selected from Group VIB for incorporation with the zeolite base.

The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms ($10^{-10}$ meters). It is preferred to employ zeolites having a relatively high silica/alumina mole ratio between about 3 and 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8-12 Angstroms ($10^{-10}$ meters), wherein the silica/alumina mole ratio is about 4 to 6. One example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006 B1.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. In one aspect, the preferred cracking bases are those which are at least about 10 percent, and preferably at least about 20 percent, metal-cation-deficient, based on the initial ion-exchange capacity. In another aspect, a desirable and stable class of zeolites is one wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and about 30 percent by weight may be used. In the case of the noble metals, it is normally preferred to use about 0.05 to about 2 weight percent.

The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., about 371° to about 648° C. (about 700° to about 1200° F.) in order to activate the catalyst and decompose ammonium ions. Alternatively, the zeolite component may first be pelleted, followed by the addition of the hydrogenating component and activation by calcining.

The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between about 5 and about 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 B1 (Klotz).

The hydrocracking in contact with a hydrocracking catalyst is conducted in the presence of hydrogen while maintaining a substantially liquid-phase continuous system and preferably at hydrocracking conditions, which may include a temperature from about 232° C. (450° F.) to about 468° C. (875° F.), a pressure from about 3.5 MPa (500 psig) to about 16.5 MPa (2400 psig) and a liquid hourly space velocity (LHSV) from about 0.1 to about 30 $hr^{-1}$. In some aspects, the hydrocracking reaction provides substantial conversion to lower boiling products, which may be the conversion of at least about 5 volume percent of the fresh feed stock to products having a lower boiling point than the feed to the second reaction zone. In other aspects, the per pass conversion in the hydrocracking zone is in the range from about 15 percent to about 70 percent and, preferably, the per-pass conversion is in the range from about 20 percent to about 60 percent. As a result, the ratio of unconverted hydrocarbons boiling in the range of the hydrocarbonaceous feed stock to the hydrocarbonaceous feed stock is from about 1:5 to about 3:5. In one aspect, the processes herein are suitable for the production of naphtha, diesel or any other desired lower boiling hydrocarbons.

Similar to the substantially liquid-phase hydrotreating zone, the feed to the substantially liquid-phase hydrocracking zone is saturated with dissolved hydrogen prior to being introduced into one or more liquid-phase continuous reactors. In another aspect, an amount of hydrogen may be added to the hydrocracking feed in excess of that required to saturate the liquid such that the substantially liquid-phase hydrocracking zone also preferably has a small vapor phase entrained in the liquid. In such aspect, the additional amount of hydrogen in the feed to the hydrocracking zone is effective to maintain a substantially constant level of dissolved hydrogen throughout the hydrocracking zone as the reaction proceeds. As discussed above in connection with the first liquid-phase hydroprocessing reaction zone, as the hydrocracking reaction proceeds and consumes the dissolved hydrogen, there is generally sufficient additional hydrogen in the small gas phase to continuously provide additional hydrogen to dissolve back into the liquid-phase in order to provide a substantially constant level of dissolved hydrogen (such as generally provided by Henry's law, for example). The liquid-phase, therefore, remains substantially saturated with hydrogen even as the hydrocracking reactions consume dissolved hydrogen. Such a substantially constant level of dissolved hydrogen is advantageous because it provides a generally constant hydrocracking reaction rate in the liquid-phase reactors.

In one aspect of the substantially liquid-phase hydrocracking reaction zone, the amount of hydrogen added to the feed thereof will generally range from an amount to saturate the stream to an amount (based on operating conditions) where the stream generally is at a transition from a liquid to a gas phase, but still has a larger liquid phase than a gas phase. In one aspect, for example, the amount of hydrogen will range from about 125 percent to about 150 percent of saturation. In other aspects, it is expected that the amount of hydrogen may be up to about 500 percent of saturation and up to about 1000 percent of saturation. In some cases, the substantially liquid-phase hydrocracking reactors will have greater than about 10 percent and, in other cases, greater than about 25 percent hydrogen gas by volume of the reactors. In another aspect, at the liquid-phase hydrocracking conditions discussed above, it is expected that about 150 to about 500 SCF/B of hydrogen will provide saturation and such additional amounts of hydrogen in excess of saturation to the hydrocracking feed in order to maintain the substantially constant saturation of hydrogen throughout the liquid-phase reactor and enable the hydrocracking reactions. It will be appreciated, however, that such hydrogen amounts will vary based on the operating conditions, feed composition, desired outputs, and other factors.

In such aspect, the hydrogen will comprise a small bubble flow of fine or generally well dispersed gas bubbles rising through the liquid-phase in the reactor. In such form, the small bubbles aid in the hydrogen dissolving in the liquid-phase. In another aspect, the liquid-phase continuous hydrocracking system may range from the vapor phase as small, discrete bubbles of gas finely dispersed in the continuous liquid-phase to a generally slug flow mode where the vapor phase separates into larger segments or slugs of gas traversing through the liquid. In either case, the liquid is the continuous phase throughout the reactors.

It should be appreciated, however, that the relative amount of hydrogen required to maintain such a substantially liquid-phase continuous hydrocracking system, and the preferred additional hydrogen thereof, is dependent upon the specific composition of the feed to this zone, the level or amount of hydrocracking desired, and/or the reaction zone temperature and pressure. The appropriate amount of hydrogen required will depend on the amount necessary to provide a liquid-phase continuous system, and the preferred additional hydrogen thereof, once all of the above-mentioned variables have been selected.

During the reactions occurring in the hydrocracking reaction zone, hydrogen is necessarily consumed. In some cases, the extra hydrogen admixed into the feed beyond that required for saturation can replace the consumed hydrogen to generally sustain the hydrocracking reaction. In other cases, additional hydrogen can also be added to the system through one or more hydrogen inlet points located in the reaction zones. In this option, the amount of hydrogen added at these locations is controlled to ensure that the system operates as a substantially liquid-phase continuous system. For example, the additional amount of hydrogen added using the hydrocracker reactor inlet points is generally an amount that maintains the saturated level of hydrogen and, in some cases, an additional amount in excess of saturation as described above.

In another aspect of the liquid-phase hydrocracking reactions, the feed to the substantially liquid-phase hydrocracking zone (i.e., the effluent or at least a portion of the effluent from the liquid-phase hydrotreating zone) also operates without a hydrogen recycle, other hydrocarbon recycle streams, or admixing other hydrocarbon streams therein because sufficient hydrogen can be supplied into the substantially liquid-phase hydrocracking reactor to at least initially effect the hydrocracking reactions without needing to dilute the feed. In such aspect, for example, the effluent from the liquid-phase hydrotreating zone is generally without a substantial hydrocarbon content provided from the second substantially liquid-phase reaction zone. Diluting or recycling streams into the feed of the liquid-phase continuous hydrocracking reaction zone would generally decrease the conversion per pass. As a result, the substantially undiluted feed provides for a less complex and smaller reactor systems to achieve the desired hydrocracking reactions.

The effluent from the substantially liquid-phase hydrocracking reaction zone is directed to a separation zone, such as a hot, high pressure flash vessel, where any vapor formed in the hydrocracking reaction zone is separated from a liquid-phase. By one approach, the hot, high pressure flash vessel operates at a temperature from about 232° C. (450° F.) to about 468° C. (875° F.), a pressure from about 3.5 MPa (500 psig) to about 16.5 MPa (2400 psig) to separate such streams. This separation zone is configured to separate any lighter products (such as light naphtha having a boiling point from about 4° C. (40° F.) to about 204° C. (400° F.), hydrogen sulfide, ammonia, C1 to C4 gaseous hydrocarbons and the like) that tend to flash at the conditions of the liquid-phase hydrocracking reaction zone. Any dissolved hydrogen in the liquid feed to the separation zone generally remains dissolved.

In another aspect, the liquid-phase from the flash vessel, which generally has an amount of hydrogen dissolved therein, is then recycled back to the liquid feed stream to the substantially liquid-phase hydrotreating reaction zone as discussed above. In one aspect, the ratio of fresh hydrocarbonaceous feed stock to liquid-phase recycle (i.e., the liquid-phase hydrocarbonaceous effluent) is about 1:1 to about 1:10 and may be about 1:1 to about 1:5. In such aspect, the separation zone enables the overall system to be maintained under liquid-phase conditions using a lower operating pressure because the lighter products formed in the hydrocracking reactions, which tend to flash into gases at the hydrocracking reactor conditions, are removed from the recycle streams at the hot high pressure flash vessel. If these lighter products (such as light naphtha, hydrogen sulfide, ammonia, C1 to C4 gaseous hydrocarbons and the like) are not removed from the liquid recycle, the pressure at the inlet to the liquid-phase hydrocracking reaction zone is typically required to be about 17.2 MPa (2500 psig) or greater in order to maintain liquid-phase conditions in the hydrocracking reaction zone. By removing the lighter hydrocracking products prior to recycling the liquid to the hydrotreating zone feed, the pressures at the inlet to the hydrotreating and/or hydrocracking reaction zones can reduced, such as between 9.6 MPa (1400 psig) to about 16.5 MPa (2400 psig), and still maintain substantially liquid-phase conditions as described above.

DETAILED DESCRIPTION OF THE DRAWING FIGURE

Turning to FIG. 1, an exemplary substantially liquid-phase hydroprocessing process will be described in more detail. It will be appreciated by one skilled in the art that various features of the above described process, such as pumps, instrumentation, heat-exchange and recovery units, condensers, compressors, flash drums, feed tanks, and other ancillary or miscellaneous process equipment that are traditionally used in commercial embodiments of hydrocarbon conversion processes have not been described or illustrated. It will be understood that such accompanying equipment may be utilized in commercial embodiments of the flow schemes as described herein. Such ancillary or miscellaneous process equipment can be obtained and designed by one skilled in the art without undue experimentation.

With reference to FIG. 1, an integrated processing unit 10 is illustrated where a hydrocarbonaceous feed stock, which preferably comprises a vacuum gas oil or a heavy gas oil, is introduced into the process via line 12 and admixed with a portion of a hereinafter described substantially liquid-phase hydrocracking zone effluent transported via line 14. A hydrogen-rich gaseous stream is provided via line 16 and also joins the feed stock 12 and the resulting admixture is a liquid feed stream transported via line 18 and introduced into a substantially liquid-phase hydrotreating zone 20. If needed, additional hydrogen can be introduced into substantially liquid-phase hydrotreating zone 20 via lines 22 and 24.

A resulting effluent stream is removed from hydrotreating zone 20 via line 28 and is joined with a second hydrogen-rich gaseous stream provided via line 30 in an amount to maintain a substantially liquid-phase continuous system. The resulting admixture is transported via line 32 and introduced into a substantially liquid-phase continuous hydrocracking zone 34. If necessary, additional hydrogen can be provided to hydrocracking zone 34 via lines 36 and 38 in an amount to maintain a substantially liquid-phase continuous system therein.

A resulting effluent stream is removed from hydrocracking zone 34 via line 40 and transported via line 44 into a hot-flash zone 46 to remove any lighter products that may flash at the conditions of the hydrocracking reactor. A hydrocarbonaceous vaporous stream containing hydrocarbons boiling in a range below the feed is removed from the hot flash zone 46 via line 48 and recovered. A liquid stream containing converted hydrocarbons is removed from hot flash zone 46 via line 50 and a portion thereof is recycled to the feed stock 12 via line 14 as previously described. In one embodiment, a ratio of fresh feed stock 12 to liquid recycle 14 is about 1:1 to about 1:10. A liquid product draw may be siphoned off the bottoms of the hot flash zone 46 via line 52.

For purposes of temperature control, a portion of the recycle stream 14 may optionally be cooled and directed to one or both reaction zones 20 and/or 34. For example, a stream 54 may be removed from the recycle 14 and sent through a cooler 56 prior to being introduced into the reaction zones via lines 58, 60, 62, and/or 64. While two quench streams are shown for each reactor, if this option is used, more or less quench streams may be used. Optionally, the stream 14 may be cooled by using cooler 66 to lower the temperature of the entire recycle stream 14.

The foregoing description of the drawing clearly illustrates the advantages encompassed by the processes described herein and the benefits to be afforded with the use thereof. In addition, FIG. 1 is intended to illustrate but one exemplary flow scheme of the processes described herein, and other processes and flow schemes are also possible. It will be further understood that various changes in the details, materials, and arrangements of parts and components which have been herein described and illustrated in order to explain the nature of the process may be made by those skilled in the art within the principle and scope of the process as expressed in the appended claims.

What is claimed is:

1. A method of hydroprocessing a hydrocarbonaceous feed stock comprising:

providing a feed stream including at least an admixture of the hydrocarbonaceous feed stock, a previously hydroprocessed liquid-phase hydrocarbonaceous stream, and hydrogen;

the hydrogen of the feed stream provided by hydrogen from the previously hydroprocessed liquid-phase hydrocarbonaceous stream and added hydrogen, the added hydrogen provided in an amount effective to increase a hydrogen content of the feed stream while maintaining the feed stream in a substantially liquid-phase condition;

directing the feed stream to a first substantially liquid-phase hydroprocessing zone to form a first effluent;

admixing an amount of hydrogen in the first effluent, the admixed hydrogen provided in an amount effective to increase a hydrogen content of the first effluent while maintaining the first effluent in a substantially liquid-phase condition;

directing the first effluent to a second substantially liquid-phase hydroprocessing zone to form a second effluent having at least a liquid component;

recycling a portion of the liquid component from the second effluent to the feed stream to provide the previously hydroprocessed liquid-phase hydrocarbonaceous stream; and the first effluent being substantially undiluted with another hydrocarbon stream.

2. The method of claim 1, wherein the hydrogen content of the feed stream is in excess of that required to saturate the feed stream.

3. The method of claim 2, wherein the amount of hydrogen admixed with the first effluent is effective to provide the hydrogen content in the first effluent in excess of that required to saturate the first effluent.

4. The method of claim 1, wherein the previously hydroprocessed liquid-phase hydrocarbonaceous stream is saturated with hydrogen.

5. The method of claim 4, wherein the second effluent is directed to a separation zone to separate one or more gaseous components from the second effluent, the separation zone operating at a temperature and pressure substantially the same as a temperature and pressure in the second substantially liquid-phase hydroprocessing zone.

6. The method of claim 1, wherein a ratio of the hydrocarbonaceous feed stock to the previously hydroprocessed liquid-phase hydrocarbonaceous stream is from about 1:1 to about 1:10.

7. A method of hydroprocessing a hydrocarbonaceous feed stock comprising:

introducing a liquid-phase feed into a first substantially liquid-phase continuous hydroprocessing zone to produce a first hydroprocessing zone effluent;

the liquid-phase feed including an admixture of a hydrocarbonaceous feed stock, a portion of a liquid-phase hydrocarbonaceous effluent from a second substantially liquid-phase continuous hydroprocessing zone, and an amount of hydrogen, the liquid-phase feed maintained under substantially liquid-phase conditions, the hydrogen therein in a form available for substantially consistent consumption in the first substantially liquid-phase continuous hydroprocessing zone;

taking at least a portion of the first hydroprocessing zone effluent as a hydroprocessing feed, the hydroprocessing feed being substantially undiluted with another hydrocarbon stream;

adding hydrogen to the hydroprocessing feed under substantially liquid-phase conditions, the hydrogen in a form available for substantially consistent consumption in the second substantially liquid-phase continuous hydroprocessing zone;

introducing the hydroprocessing feed into the second substantially liquid-phase hydroprocessing zone to provide a second hydroprocessing zone effluent having gaseous hydrocarbons and liquid hydrocarbons;

separating the second hydroprocessing zone effluent in a separation zone into a gas-phase effluent including the gaseous hydrocarbons and the liquid-phase hydrocarbonaceous effluent including the liquid hydrocarbons; and recycling at least a portion of the liquid-phase hydrocarbonaceous effluent to the liquid-phase feed.

8. The method of claim 7, wherein the amount of hydrogen in the liquid-phase feed is in excess of that required to saturate the liquid-phase feed.

9. The process of claim 8, wherein the amount of hydrogen added to the liquid-phase feed is up to about 1000 percent over that required for saturation of the liquid-phase feed.

10. The method of claim 7, wherein the hydrogen added to the hydroprocessing feed is in an amount in excess of that required for saturation of the hydroprocessing feed.

11. The process of claim 10, wherein the amount of hydrogen added to the hydroprocessing feed is up to about 1000 percent over that required for saturation of the hydroprocessing feed.

12. The process of claim 7, wherein the liquid-phase hydrocarbonaceous effluent has an amount of hydrogen therein.

13. The process of claim 7, wherein the first substantially liquid-phase continuous hydroprocessing zone is a substantially liquid-phase continuous hydrotreating zone.

14. The process of claim 7, wherein the second substantially liquid-phase continuous hydroprocessing zone is a substantially liquid-phase continuous hydrocracking zone.

15. The process of claim 14, wherein the substantially liquid-phase continuous hydrocracking zone is capable of maintaining substantially liquid-phase conditions at an inlet thereof at pressures of about 16.5 MPa (2400 psig) or less.

16. The process of claim 7, wherein a temperature and a pressure in the separation zone are substantially the same as a temperature and a pressure in the substantially liquid-phase hydrocracking zone.

17. A method of hydroprocessing a hydrocarbonaceous feed stock comprising:

providing a liquid-phase feed including an admixture of a hydrocarbonaceous feed stock, a portion of a liquid-phase hydrocarbonaceous effluent from a substantially liquid-phase continuous hydrocracking zone, and hydrogen while maintaining a substantially liquid-phase condition, the hydrogen in an amount in excess of that required for saturation of the liquid-phase feed;

introducing the liquid-phase feed into a substantially liquid-phase continuous hydrotreating zone operated at hydrotreating conditions to produce a hydrotreating zone effluent having hydrogen sulfide and ammonia;

adding hydrogen in the hydrotreating zone effluent in an amount in excess of that required for saturation of the hydrotreating zone effluent;

introducing the hydrotreating zone effluent substantially undiluted with another hydrocarbon stream into the substantially liquid-phase continuous hydrocracking zone to provide a hydrocracking zone effluent having a gaseous component and a liquid component having an amount of hydrogen therein;

separating the hydrocracking zone effluent in a separation zone into a gas-phase effluent including the gaseous component and the liquid-phase hydrocarbonaceous effluent including the liquid component; and recycling at least a portion of the liquid-phase hydrocarbonaceous effluent to the liquid-phase feed.

18. The method of claim 17, wherein the gaseous component formed in the substantially liquid-phase continuous hydrocracking zone includes light naphtha having a boiling point from about 4° C. (40° F.) to about 204° C. (400° F.), hydrogen sulfide, ammonia, C1 to C4 gaseous hydrocarbons, and combinations thereof.

19. The method of claim 17, wherein a ratio of hydrocarbonaceous feed stock to liquid-phase hydrocarbonaceous effluent is about 1:1 to about 1:10.

20. The method of claim 17, wherein a temperature and pressure in the substantially liquid-phase continuous hydrocracking zone is substantially the same as a temperature and pressure in the separation zone.

* * * * *